US006640519B1

(12) United States Patent
Goodwin

(10) Patent No.: US 6,640,519 B1
(45) Date of Patent: Nov. 4, 2003

(54) METHOD AND APPARATUS FOR PRODUCING BAGS HAVING A RECLOSEABLE FASTENER

(75) Inventor: James Goodwin, Beeston (GB)

(73) Assignee: Molins PLC, Milton Keynes (GB)

( * ) Notice: Subject to any disclaimer, the term of this patent is extended or adjusted under 35 U.S.C. 154(b) by 65 days.

(21) Appl. No.: 09/661,374

(22) Filed: Sep. 13, 2000

(30) Foreign Application Priority Data

Sep. 24, 1999 (GB) ..... 9922747

(51) Int. Cl.[7] ..... B65B 61/20; B31B 1/90

(52) U.S. Cl. ..... 53/133.4; 53/133.3; 53/139.2; 493/213; 493/214; 156/66

(58) Field of Search ..... 493/927, 210, 493/212, 213, 214; 53/412, 133.3, 133.4, 139.2; 156/66

(56) References Cited

U.S. PATENT DOCUMENTS

| | | | | |
|---|---|---|---|---|
| 4,655,862 A | | 4/1987 | Christoff et al. | |
| 4,878,987 A | | 11/1989 | Ven Erden | |
| 4,909,017 A | * | 3/1990 | McMahon et al. | 156/66 |
| 5,782,733 A | * | 7/1998 | Yeager | 493/213 |
| 5,930,983 A | * | 8/1999 | Terminella et al. | 53/133.4 |
| 6,032,437 A | * | 3/2000 | Bois | 493/213 |
| 6,044,621 A | * | 4/2000 | Malin et al. | 493/214 |
| 6,088,998 A | * | 7/2000 | Malin et al. | 493/214 |
| 6,099,451 A | * | 8/2000 | Mulder et al. | 493/213 |
| 6,131,374 A | * | 10/2000 | Bois | 493/214 |
| 6,212,857 B1 | * | 4/2001 | Van Erden | 156/66 |

FOREIGN PATENT DOCUMENTS

| | | |
|---|---|---|
| DE | 298 08 817 U1 | 10/1999 |
| EP | 0 933 193 A2 | 8/1999 |

* cited by examiner

*Primary Examiner*—John Sipos
*Assistant Examiner*—Louis Huynh
(74) *Attorney, Agent, or Firm*—Antonelli, Terry, Stout & Kraus, LLP

(57) ABSTRACT

An apparatus (50) for securing a fastening strip (58) to a web (18) of packaging material comprises an anvil (100) which defines a support surface for the web. The support surface has an elongate recess (104) for receiving the fastening strip. There is a moveable sealing device (116) disposed opposite and below the support surface and a retractable support element (130) disposed between the support surface and sealing device. A feeding arrangement feeds the fastening strip along the recess and between the support element and the support surface arrangement. Suction is applied via a vacuum chamber (102) to hold the fastening strip in the recess and permit the support element to be retracted to a position which permits the sealing device to move the web into engagement with the support surface and the fastening strip with the fastening strip received in the recess to permit sealing of the fastening strip to the web.

16 Claims, 3 Drawing Sheets

METHOD AND APPARATUS FOR PRODUCING BAGS HAVING A RECLOSEABLE FASTENER

BACKGROUND OF THE INVENTION

The invention relates to methods and apparatus for producing bags having a recloseable fastener and in particular bags in which such a fastener extends in substantially the same direction as the top and bottom seals of the bag.

It is well known to make bags by a form, fill and seal (FFS) process. The FFS process is well known and will be described herein with reference to vertical, form, fill and seal (VFFS) machines. In such a machine, a web of flexible packaging material is fed over a forming shoulder to form a tube about a vertically oriented filling pipe. The edges of the web are sealed together in the longitudinal direction of the tube and then successive transverse seals are made at bag length intervals by means of opposed sealing jaws. One jaw of an opposed pair usually carries a knife which cuts through the tubular web at each transverse seal to provide a top seal for a completed bag and a bottom seal for the following bag. Product is fed down the forming tube in synchronicity with the sealing jaws so that each package contains a required amount of product.

It is also known to provide bags produced on FFS machines with a recloseable fastener. Such fasteners typically take the form of two elongate elements one of which comprises a rib extending along the length of the element and the other of which has a channel which receives the rib. The arrangement of the elements is such that the rib can be pushed into the channel and will be releasably retained therein to form a fastening. Such fasteners will be referred to herein as zips or zip fasteners.

One approach to applying zips to bags produced on VFFS machines has been to apply the zip to the web before it reaches the forming shoulder. The web approaches the forming shoulder in planes which may be horizontal but are at least transverse to the axis of the forming tube. The zip is fed from a supply reel across the web from one side thereof with the two elements of the zip engaged, ie with the rib received in the channel. At the location at which the zip is to be applied to the web, a length of the zip substantially equal to the width of the bag is cut and then the cut length is secured to the web by means of a heat sealing jaw. In more detail, one of the two elements of the zip is secured to the upwardly facing side of the web by heat welding. The element may be securely welded to the web or tacked onto the web. The web with attached zip then passes over the forming tube and when the opposed sealing jaws meet to form the transverse bag seals, the elements of the fastening strip are simultaneously welded to their respective sides of the bag just below the top seal of the bag.

SUMMARY OF THE INVENTION

The invention provides apparatus for securing a fastening strip to a web of packaging material, said apparatus comprising means defining a support surface for said web, said support surface having an elongate recess for receiving said fastening strip, movable sealing means disposed opposite and below said support surface, a retractable support element disposed between said support surface and said sealing means, means for feeding said fastening strip in a lengthwise direction of said recess and between said support element and said support surface and means for holding said fastening strip, the arrangement being such that said support element can be retracted to a position which permits said sealing means to move said web into engagement with said support surface and said fastening strip with said fastening strip received in said recess, said holding means being actuable to hold said fastening strip when said support element is retracted.

The invention also includes a method of securing a fastening strip to a web of packaging material, said method comprising the steps of feeding said fastening strip across said web such that a length of said strip is positioned at a predetermined position relative to said web, providing a support for said fastening strip during said feeding step, applying a holding force to said fastening strip and withdrawing said support, moving said web into engagement with said fastening strip and securing said web to said fastening strip.

BRIEF DESCRIPTION OF THE DRAWINGS

In order that the invention may be well understood, an embodiment thereof, which is given by way of example only, will now be described with reference to the accompanying drawings, in which.

DESCRIPTION OF PREFERRED EMBODIMENTS

Figure 1:
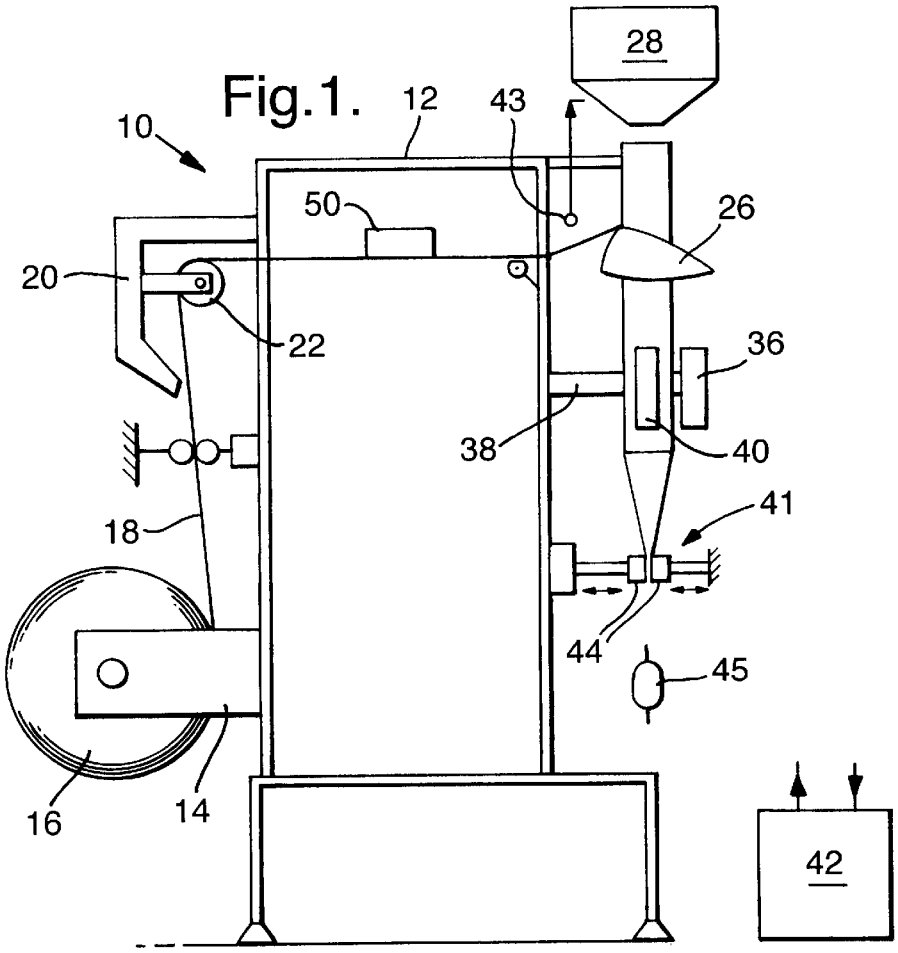
FIG. 1 is a schematic side elevational of a vertical, form, fill and seal machine for making recloseable bags.

FIG. 1 is a schematic side elevation view of a VFFS machine 10 for making recloseable bags. The machine comprises a frame 12 to the rear of which is fixed a mounting device 14. The mounting device 14 is arranged to receive a reel 16 of packaging film which is held so as to be rotatable whereby the film, or web 18, can be gradually payed off from the reel by means of a nip roller drive 19 or, alternatively a motor drive (not shown). It will be understood that the position of the nip drive 19 indicated in FIG. 1 is purely exemplary and that it may be positioned at any suitable position on the machine.

The web 18 passes upwardly from the mounting device to a first roller unit 20, also mounted at the rear of the frame. The roller unit 20 comprises one or more rollers (illustrated schematically as roller 22) around which the web is guided and is arranged such that the web is directed generally horizontally towards the front of the frame 12.

A cylindrical filling tube 24 is supported on the front of the frame and carries a forming shoulder 26. A weigher or other control device 28 is mounted above the filling tube 24 and serves to drop predetermined amounts of product into the filling tube.

The web 18 is directed from the roller 22 towards the filling tube 24 and the forming 26 shoulder is arranged to cause the web to adopt a tubular configuration about the filling tube 24. Downstream of the forming shoulder, there is a heat sealing unit 36 which is positioned at the front of the machine and connected to the frame 12 by means of an L-shaped connecting arm 38. The heating sealing unit may be of any known form including a hot air unit such as that disclosed in WO98/40202, the content of which is incorporated herein by reference.

Two drive bands 40, or alternatively draw-off rollers, are arranged on opposite sides of the forming tube 24 to draw the web 18 downwardly towards a transverse sealing and cutting device 41. The drive bands 40 and nip roller drive are controlled by a control system 42 and provide a web feed arrangement for the VFFS machine 10. A photoelectric cell 43, or other suitable sensing device, is positioned adjacent the forming shoulder to detect registration marks on the web 18. The control system uses the signals provided by the sensor 43 to control the web feed.

The sealing and cutting device 41 comprises opposed reciprocating sealing jaws 44, which serve to form transverse seals in the film to define a succession of packages. The sealing jaws are preferably actuated by respective pneumatic cylinders (not shown). One jaw of the pair includes a blade (not shown) by means of which the individual packages 45 are separated from the film. The arrangement and form of the jaws may be of any suitable conventional type and since suitable sealing jaw arrangements will be familiar to those skilled in the art, the sealing jaws and knife arrangement will not be described in detail herein.

The control system 42 is arranged to provide suitable control signals for synchronising the operations carried out by various parts of the machine. The control system can be of any known type and may, for example, comprise a PLC. Control systems for bag making machinery are well know to those skilled in the art and will not therefore be described in any further detail herein.

A zip applying apparatus 46 is provided for applying a length of zip to the web 18 upstream of the forming shoulder 26.

Figure 3:
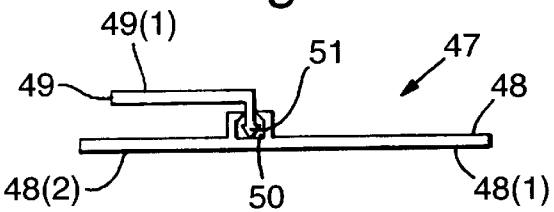
FIG. 3 is a schematic side elevation of a zip which can be used with the zip applying apparatus of FIG. 2.

FIG. 3 is a schematic representation of a typical configuration of zip fastener 47. The zip fastener 47 comprises two elements 48,49. The lowermost element 48 defines a recess 50 that is arranged to snap-fittingly engage with a projection 51, which is a part of the upper element 49. In order to seal the zip fastener to the bag, three seals will be made. The seals will be made in the regions 48(1), 48(2) and 49(1) of the zip, which will be applied to the web such that the region 48(1) forms the leading edge of the zip as the web is fed downstream of the zip applying apparatus.

It is to be understood that the zip fastener 47 shown in FIG. 3 has been shown simply to illustrate the functioning of the zip applying apparatus 46 and that the apparatus and invention are not limited to use with that particular configuration of zip.

Figure 2:
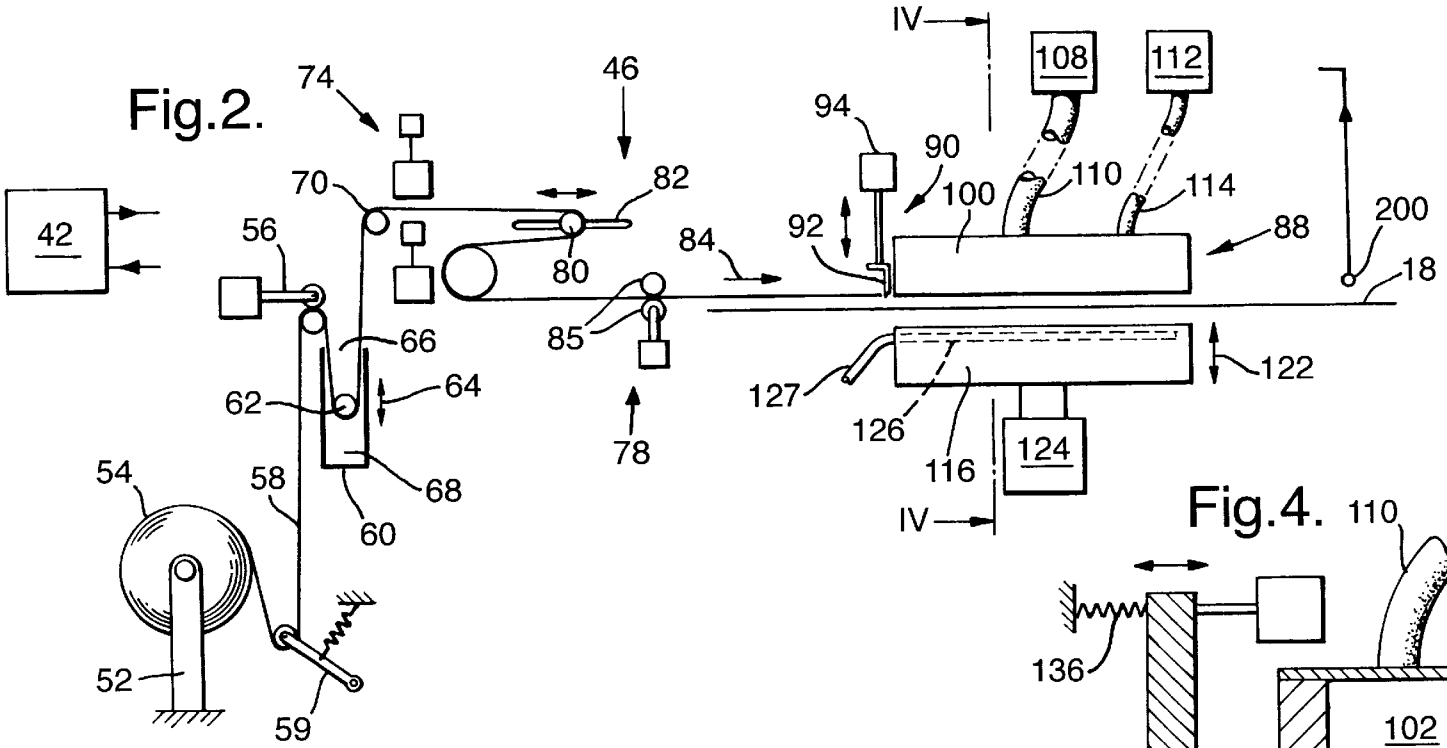
FIG. 2 is a schematic representation of a zip applying apparatus for the machine shown in FIG. 1.
Figure 4:
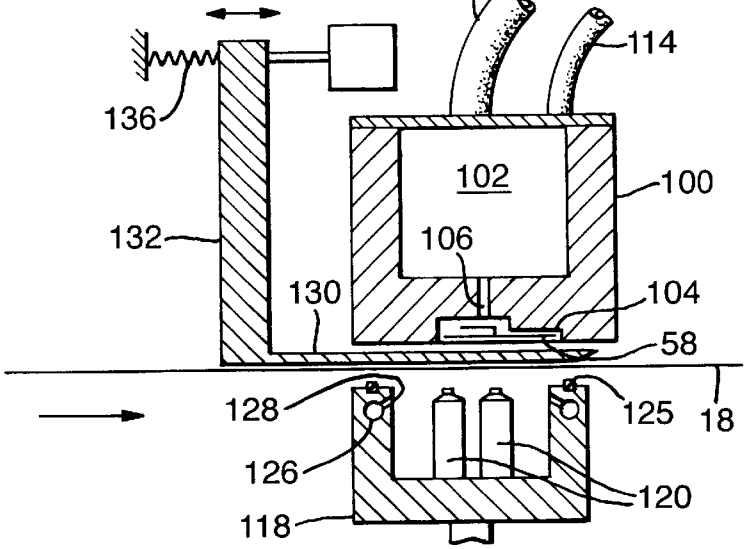
FIG. 4 is a section on line IV—IV in FIG. 2.
Figure 6:
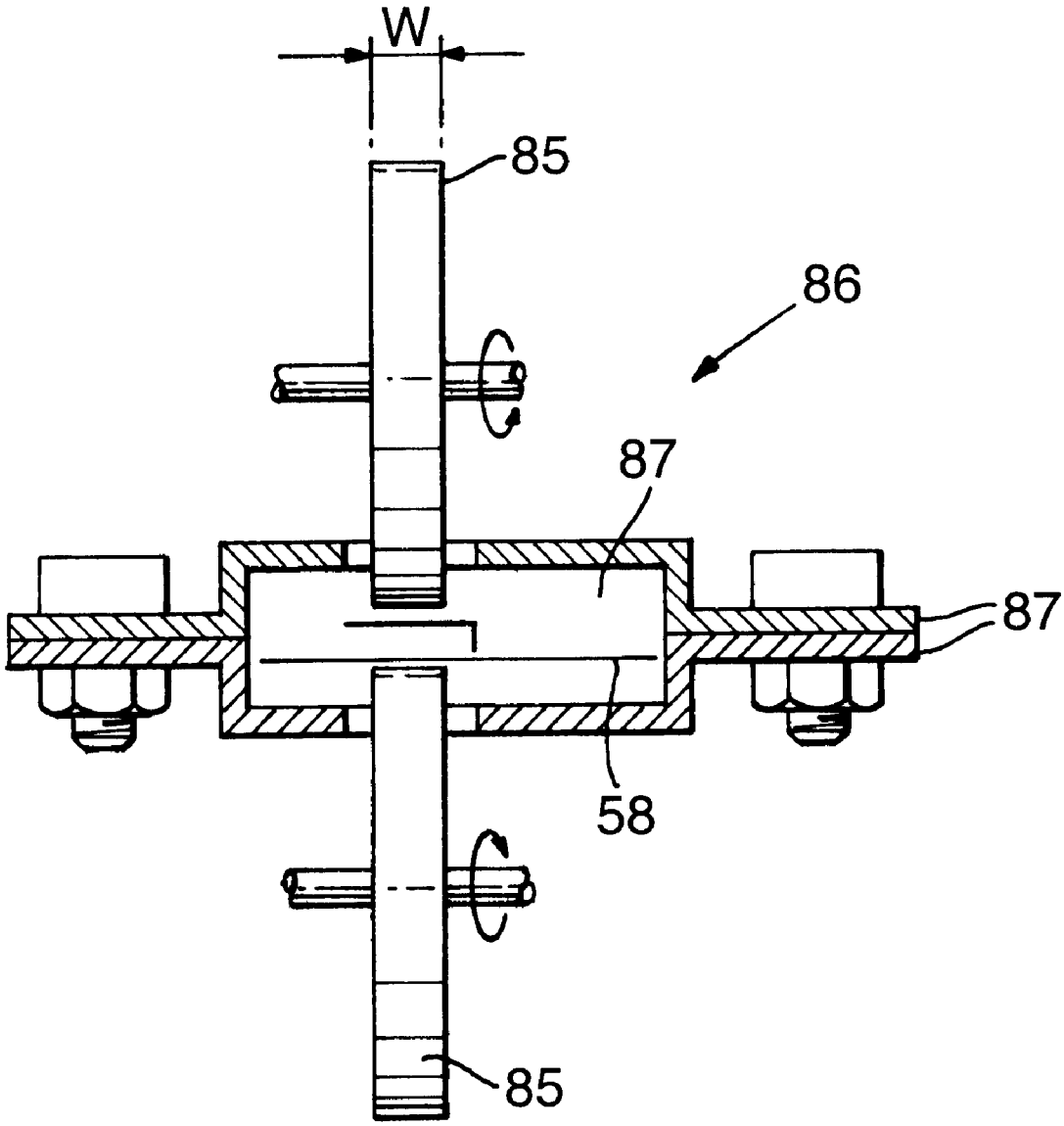
FIG. 6 is a schematic section view of a zip strip guide of the zip applying apparatus.

Referring to FIGS. 2, 4 and 6, the zip applying apparatus 46 includes a reel stand 52 for mounting a reel 54 of zip 47 in strip form and a nip drive 56 for drawing the zip strip 58 from the reel. The nip drive draws the zip strip over a roller mounted on a banjo arm 59 and feeds it into a reservoir 60 which houses a roller 62 supported by the zip strip. The roller 62 is free to move in the directions indicated by the arrow 64. An upper limit sensor 66 and a lower limit sensor 68 are arranged to detect the presence of the roller 62 when it reaches respective limit positions.

Downstream of the reservoir 60, the zip strip passes over a guide roller 70 which guides the strip into a first sealing device 74, which is arranged to form spot welds at spaced intervals along the strip. The sealing device 74 is described in more detail hereinbelow.

Downstream of the sealing device 74, there is a further guide roller 76 which guides the strip to a nip drive 78. Intermediate the sealing device 74 and guide roller 76, there is a registration adjustor, which includes a roller 80. The roller 80 is releasably mounted in a pair of opposed guide slots 82, whereby its position relative to the sealing device 74 can be adjusted.

The nip drive 78 is arranged to feed the zip strip 58 over the web 18 in a direction, indicated by arrow 84, which is transverse to the direction in which the web is feeding.

As best seen in FIG. 6, the nip drive 78 preferably comprises two opposed rollers 85 of matched diameter and each having a knurled circumferential surface for engaging the zip strip 58. The rollers 85 have a width (W) which is significantly less than that of the zip strip and are arranged to grip on the center portion of the zip strip. For example in one embodiment, the rollers 79 have a width of 5 mm for use with a zip strip having a width of 25 mm. Preferably, both rollers 79 are driven synchronously. It will be appreciated that this arrangement ensures that both elements of the zip strip are positively fed so that there is no tendency for slippage between them. A zip strip guide 86 is associated with the rollers 79 and serves to prevent the zip strip wrapping around the rollers 79. The zip strip guide comprises two opposed plates secured together and shaped to define a channel 87 for the zip strip 58. Each plate is provided with an aperture into which a portion of the respective roller 85 protrudes so that it can engage the zip strip.

A second sealing device 88 is positioned in the path of the web 18 for sealing lengths of the zip strip to the web. A zip knife 90 is provided adjacent the sealing device 88 for severing the lengths of zip from the strip 58. The zip knife includes a blade 92 and a pneumatic cylinder 94 arranged to reciprocate the blade as indicated in FIG. 2.

As best seen in FIG. 4, the second sealing device 88 comprises an anvil 100 which defines a vacuum chamber 102. The anvil 100 additionally defines a profiled slot 104 which extends across the entire width of the anvil. The slot 104 is connected with the chamber 102 by means of a series of bores 106 spaced along the length of the slot. The vacuum chamber is connected with a vacuum source 108 by means of a pipe 110 and with a source of pressurised air 112 by means of a pipe 114.

The second sealing device also includes a sealer 116 which comprises a clamping block 118 (FIG. 4) carrying two impulse sealers 120.

The clamping block 118 is arranged to be reciprocated in the direction indicated by the arrow 122 (FIG. 2) by means of a pneumatic cylinder 124.

The clamping block is provided with rubber cushions 125. The clamping block 118 includes two bores 126 extending across the width of the sealer 116 and connected to the pressurised air source 112 by means of a pipe 127. Each bore 126 communicates with a respective series of angled bores 128, which are directed inwardly and upwardly of the clamping block.

A support plate 130 is arranged between the housing 102 and clamping block 118 and is connected with an arm 132 which is in turn connected with a pneumatic cylinder 134. The cylinder 134 is actuable to retract the support plate from its position between the housing and clamping block to permit the clamping block to be moved by the pneumatic cylinder 124 to a position in which it presses the web 18 against the underside of the anvil 100. The pneumatic cylinder may be arranged to move the guide plate against a return spring 136 or may be a double-acting cylinder, in which case, a return spring is not required.

Figure 5:
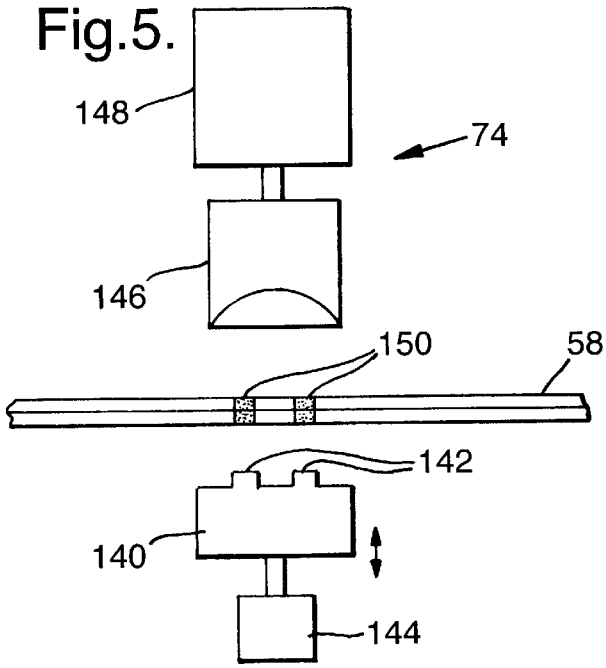
FIG. 5 shows details of a sealing device of the apparatus shown in FIG. 2.

As shown in FIG. 5, the first sealing device 74 comprises an anvil 140 which defines two projections 142. The anvil is arranged to be reciprocated by means of a pneumatic cylinder 144. In transverse cross-section perpendicular to the plane of the drawing, the projections are preferably substantially rectangular.

The first sealing device 74 also includes a horn 146 disposed opposite the anvil 140 and a source of ultrasound 148.

In use, the web 18 feeds from the reel 16 onto the forming shoulder 26 which causes it to wrap around the filling tube 24 and adopt a tubular configuration corresponding substantially to the shape of the forming tube. At bag length intervals, the web feed is halted and the sealing unit 36 applies heat to the longitudinal edges of the tubular web to form a continuous seal extending parallel to the axis of the forming tube. At the same time, the sealing jaws 44 move towards one another to engage the web and form transverse seals each of which defines the top seal of a completed bag 45 and the bottom seal of a bag being formed immediately upstream thereof. The blade carried by one of the sealing jaws severs the web through the transverse seal to separate the bag 45 from the web. The zip is applied to the web, whilst the web feed is halted to allow the formation of the transverse seals.

The zip applying apparatus 46 operates by drawing zip strip 58 from the reel by means of the nip drive 56 which feeds the strip into the reservoir 60. The length of strip contained in the reservoir supports the roller 62 against the influence of gravity and the nip drive 56 is actuated in response to signals from the sensors 60, 62.

The nip drive 78 is actuated to draw bag width lengths of zip strip from the reservoir. When the nip drive 78 is not feeding, the sealing device 74 is actuated to form spot welds 150 between the two elements of the zip strip. The arrangement of the sealing device 74 is such that the zip strip is positioned close to the horn 146 and to form a seal the anvil 140 is raised to bring the projections into engagement with the zip whilst the source 148 is activated to generate ultrasound vibrations which are fed into the horn. Each sealing operation provides a pair of spot welds 150 and the sealing operations are timed so that the pairs of spot welds are formed at spaced locations along the length of the strip, the spacing between adjacent pairs corresponding approximately to the width of the completed bag 46.

Each time the nip drive 78 is actuated, it feeds a bag width length of zip strip across the web in a direction 84 which is perpendicular to the direction in which the web is fed. Whilst the zip is feeding across the web 18, it is supported by the support plate 130 so that it does not contact the web 18 which can be feeding at the same time without the problem of the web movement affecting the tracking of the zip strip, which can therefore be accurately aligned across the web. As it moves across the support plate, the zip is guided by the slot 104.

When the web 18 is halted to form the transverse seal, the vacuum source 108 is connected with the vacuum chamber so that the zip strip is held in the recess 104. The pneumatic cylinder 134 is actuated to retract the support plate and the clamping block is raised by means of the cylinder 124 to push the web 18 into contact with the zip contained in the recess and the underside of the anvil which acts as a support surface for the web whilst the impulse sealers are activated to seal the web to the underside of the lowermost zip element 48; seals being formed between the web and the regions 48(1) and 48(2) of the zip. Substantially simultaneously, the blade 92 is moved by the cylinder 94 to cut through the zip strip between adjacent pairs of spot welds 150.

It will be understood that by providing pairs of spot welds 150 at bag length intervals and cutting between welds of a pair so that the leading weld is at the trailing end of the length of strip attached to the web and the trailing weld is positioned ready to be fed across the web the next time the nip drive 78 is actuated, each length of zip strip attached to the web has a spot weld at its end regions, which will be at opposite sides of the bag opening. This arrangement of the welds in the bag opening serves to maintain registration of the zip elements when the zip is opened making it easier to close the zip and reseal the bag.

Where necessary, for example when applying zip to polyethylene and similar materials, cooling air can be directed at the web via the bores 128.

Once the cutting of the zip is complete, the vacuum source is disconnected and pressurised air is fed into the chamber 102 to drive the zip from the recess 104. The web 18 can then feed forward towards the forming shoulder 26.

The second sealing device 88 preferably forms a complete seal between the zip element 48 and the web. However, the seal may only be partial such that it is sufficient to hold the zip in place during the forming processes which occur downstream of the zip applying apparatus. The sealing of the other zip element 49 to the web 18 takes place between the sealing jaws 44 as is already known in the art. If the zip-applying device has only partially sealed the zip element to the web, the complete seal is formed between the sealing jaws. Sealing jaws for forming seals between one or both elements of the zip are known in the art of bag making and will not be described in further detail herein.

It will be appreciated that another advantage of the arrangement of the zip applying apparatus 46 is that when the zip feed process is complete and the zip is correctly positioned over the web 18, withdrawal of the support plate 130 whilst the zip is held from above, permits access to both the regions 48(1), 48(2) so that the zip element 48 can be finish sealed to the web. Thus when the zip reaches the sealing jaws 44, the only operation additional to the transverse sealing of the web is the forming of a seal between the web and the upper zip element 49, thereby permitting the sealing process to be carried out more quickly should this be desired. This possibility has been found to be particularly advantageous in use of the machine 10 to form so-called block bottom bags. It is, however, to be understood that the apparatus is not limited to this feature and that it is possible for the second sealing device to be configured to produce only a seal at the region 48(1) should this be desired.

It will be appreciated that another advantage of the provision of the support plate is that it allows the web 18 and zip strip to be fed simultaneously and the web feed only need be halted for long enough for the various seals to be formed.

The zip applying apparatus may be used with a VFFS machine in which the jaws are continuously rotated and the web 18 is fed continuously from the reel 16 and between the rotary sealing jaws. The rotary sealing jaws may be guided so as to follow a generally D-shaped or rectangular (box-like) path. If the apparatus is to be used with such a continuous machine it would be necessary to provide an accumulator to permit the web feed to be interrupted upstream of the forming shoulder to allow the zip to be applied to a stationary web portion whilst continuous motion of the web between the sealing jaws is maintained. Such accumulators and other lost motion devices which would permit the apparatus to be used in a continuous motion bag making machine will be well known to those skilled in the art and will not therefore be described in any further detail herein.

The registration device 82 allows the length of zip strip between the sealing device 74 and the cutting blade 92 to be varied manually according to the desired bag width so that the cutting blade will always sever the strip between a pair of adjacent spot welds 150. Although, the roller 80 could be servo driven in order to provide a dynamic adjustment, it is envisaged that the roller will be moved to a desired position and clamped in place as part of a setting up procedure.

In a modification to the zip applying apparatus 46, a photoelectric cell 200 may be provided for detecting registration marks on the web adjacent the zip applying apparatus 46. The signals from the photoelectric cell 200 are used to control the nip roller drive 78 independently of the signals from the sensor 43. Providing separate sensors located at optimum positions relative to the zip applying apparatus and the transverse sealing device 41, permits more accurate positioning of the zip and the transverse seal relative to any printed matter on the web.

A further modification would be to provide a further nip drive for the web immediately adjacent the zip applying apparatus which could be driven independently or in synchronisation with the web feed arrangement. If this further nip drive is to be driven independently, an intermediate reservoir, for example an arrangement such as the roller mounted on a banjo arm 59, would be employed to accommodate any differences in the web feed provided by the web feed arrangement and the further nip drive.

It will be understood that the machine 10 could be readily modified to feed a continuous stream of bags to a coiling device to form a reel of performed bags which can be fitted to another machine for filling and scaling.

I claim:

1. Apparatus for securing a fastening strip to a web of packaging material, said apparatus comprising a member disposed above a feed path of the web, said member having an elongate recess for receiving said fastening strip, a sealer movable against said member, a retractable strip support disposed opposite said member, a feed arrangement for feeding said fastening strip in a lengthways direction of said recess and between said strip support and said member, a holding mechanism for holding said fastening strip in said recess, and a mechanism for retracting said strip support from a position between the feed path of the web and said recess to a position which permits said sealer to move said web into engagement with said member and said fastening strip with said fastening strip received in said recess, said holding mechanism being actuated to hold said fastening strip when said strip support is retracted.

2. Apparatus as claimed in claim 1, wherein said holding mechanism comprises at least one passage connecting said recess with a vacuum source.

3. Apparatus as claimed in claim 1, further comprising a pushing mechanism for pushing said fastening strip outwardly of said recess.

4. Apparatus as claimed in claim 3, wherein said pushing mechanism comprises a passage for communicating said recess with a source of pressurised gas.

5. Apparatus as claimed in claim 1, wherein said sealer comprises at least one impulse heater.

6. Apparatus as claimed in claim 1, further comprising a cutting device arranged to cut through said fastening strip at a position adjacent an upstream end of said recess.

7. Apparatus for securing a fastening strip to a web of packaging material, said apparatus comprising:

a feed arrangement for feeding said fastening strip over said web such that said fastening strip is disposed transverse to a lengthways direction of said web;

a sealer for sealing said fastening strip to the web;

a retractable support for said fastening strip having a support position disposed between said fastening strip and said web for supporting said fastening strip relative to said web;

a releaseable gripper arranged to grip said fastening strip over said web; and a retractor operatively connected with said retractable support, the arrangement being such that said releaseable gripper is operable to grip said fastening strip over said web and said retractor is synchronously operable to retract said retractable support from said support position to permit said sealer to seal said fastening strip to said web.

8. Apparatus as claimed in claim 7, wherein said sealer is movable into engagement with said web such that it moves said web against said fastening strip.

9. Apparatus as claimed in claim 7, wherein said gripper comprises a vacuum attachment device.

10. Apparatus as claimed in claim 7, wherein said fastening strip comprises a first element having a first engaging portion and a second clement having a second engaging portion interengageable with said first engaging portion, said feed arrangement being arranged to feed said fastening strip over said web such that a side of said second element remote from said second engaging portion is disposed opposite said web and said sealer being arranged to seal said web to said side of said second element on either side of said second engaging portion such that no further sealing operation is required between said side of said second element and said web.

11. In combination, a vertical form, fill and seal packaging machine and apparatus for securing a fastening strip to a planar web of packaging material in said packaging machine, said machine comprising:

a web feeder for feeding said web;

a former for causing said planar web to adopt a generally tubular configuration;

a first sealer for forming a continuous seal in a lengthways direction of said tubular configuration web for sealing respective lengthways extending edges of said web in adjacent relationship;

a second sealer for forming transverse seals at spaced intervals along said tubular configuration web; and said apparatus being disposed upstream of said former and comprising:

a feeding arrangement for feeding said fastening strip over said web such that said fastening strip is disposed transverse to a lengthways direction of said web;

a sealer for sealing said fastening strip to the web;

a retractable support for said fastening strip having a support position disposed between said fastening strip and said web for supporting said fastening strip relative to said web;

a releasable gripper arranged to grip said fastening strip over said web; and a retractor operatively connected with said retractable support, the arrangement being such that said gripper is operable to grip said fastening strip over said web and said retractor is synchronously retract said retractable support to permit said sealer from said support position to seal said fastening strip to said web.

12. The combination claimed in claim 11, wherein said feed arrangement and said web feeder each have an intermittent feed cycle whereby said fastener strip and said web, at least adjacent said apparatus, are stopped to permit sealing therebetween, and said web feeder and said feed arrangement operate simultaneously over at least a portion of said feed cycles.

13. The combination claimed in claim 12, further comprising a controller for said web feeder and said feed arrangement.

14. The combination claimed in claim 13, wherein said controller includes a programmable logic control for controlling said web feeder and said feed arrangement.

15. The combination claimed in claim 13, further comprising two sensors for sensing registration marks provided on said web, said sensors providing respective signals to said controller for use in controlling said web feeder and said feed arrangement.

16. The combination claimed in claim 15, wherein one of said sensors is disposed adjacent said apparatus and another is disposed adjacent said former.

* * * * *